US009357818B2

(12) United States Patent
De Oliveira

(10) Patent No.: US 9,357,818 B2
(45) Date of Patent: Jun. 7, 2016

(54) REMOVABLE CONNECTING DEVICE OF A WRIST BAND

(71) Applicant: HUBLOT S.A., GENEVE, Geneva (CH)

(72) Inventor: Stéphane De Oliveira, Bellignat (FR)

(73) Assignee: HUBLOT S.A., GENEVE, Geneva (CH)

( * ) Notice: Subject to any disclaimer, the term of this patent is extended or adjusted under 35 U.S.C. 154(b) by 99 days.

(21) Appl. No.: 14/360,234

(22) PCT Filed: Nov. 22, 2012

(86) PCT No.: PCT/EP2012/073411
§ 371 (c)(1),
(2) Date: May 22, 2014

(87) PCT Pub. No.: WO2013/076220
PCT Pub. Date: May 30, 2013

(65) Prior Publication Data

US 2014/0353349 A1 Dec. 4, 2014

(30) Foreign Application Priority Data

Nov. 22, 2011 (CH) ..... 1870/11

(51) Int. Cl.
*A44C 5/14* (2006.01)
*G04B 37/14* (2006.01)

(52) U.S. Cl.
CPC ..... *A44C 5/14* (2013.01); *G04B 37/1486* (2013.01); *Y10T 24/4782* (2015.01)

(58) Field of Classification Search
CPC ..... A44C 5/14; G04B 37/1486
See application file for complete search history.

(56) References Cited

U.S. PATENT DOCUMENTS 2,850,783 A * 9/1958 Megar ..... A44C 5/145 24/265 WS
2,990,988 A * 7/1961 Ziegenbein ..... A44C 5/14 242/265 WS
3,889,323 A * 6/1975 Reith ..... A44C 5/14 224/177
3,924,418 A * 12/1975 Burkle, Jr. ..... A44C 5/107 224/164

(Continued)

FOREIGN PATENT DOCUMENTS

EP 1 219 199 A2 7/2002

OTHER PUBLICATIONS

International Search Report dated Mar. 6, 2013 issued in corresponding application No. PCT/EP2012/073411.

(Continued)

*Primary Examiner* — Brian D Nash
(74) *Attorney, Agent, or Firm* — Westerman, Hattori, Daniels & Adrian, LLP

(57) ABSTRACT

A connecting device includes two complementary coupling members (3, 4) secured respectively to the connecting ends of a wrist band (2*a*, 2*b*) and of the component to which it is attached. The coupling members (3*a*, 3*b*) are oriented transversely to the longitudinal direction of the wrist band (2*a*, 2*b*). One (3) of the coupling members is movable laterally between two end positions, a first position in which it is engaged with the other (4) of said coupling members, and a second position in which it is dissociated from said other coupling member (4). An elastic return force (5) tends to keep said coupling member (3) movable laterally between two end positions in said first position.

25 Claims, 3 Drawing Sheets

(56) References Cited

U.S. PATENT DOCUMENTS

| | | | | |
|---|---|---|---|---|
| 4,266,326 | A * | 5/1981 | Hong | A44C 5/14 224/177 |
| 4,468,134 | A * | 8/1984 | Halicho | G04B 39/00 368/308 |
| 5,812,500 | A * | 9/1998 | Webb, Jr. | A44C 5/0053 368/10 |
| 6,324,729 | B1 * | 12/2001 | Daubenthaler | A44C 5/00 24/182 |
| 2005/0217080 | A1 * | 10/2005 | Kojoori et al. | A44B 11/006 24/265 WS |
| 2006/0180000 | A1 | 8/2006 | Pernu et al. | |
| 2007/0067967 | A1 | 3/2007 | Sima | |
| 2011/0197400 | A1 | 8/2011 | Chevrolet | |

OTHER PUBLICATIONS

Written Opinion of the International Searching Authority dated Mar. 6, 2013 issued in corresponding application No. PCT/EP2012/073411.

* cited by examiner

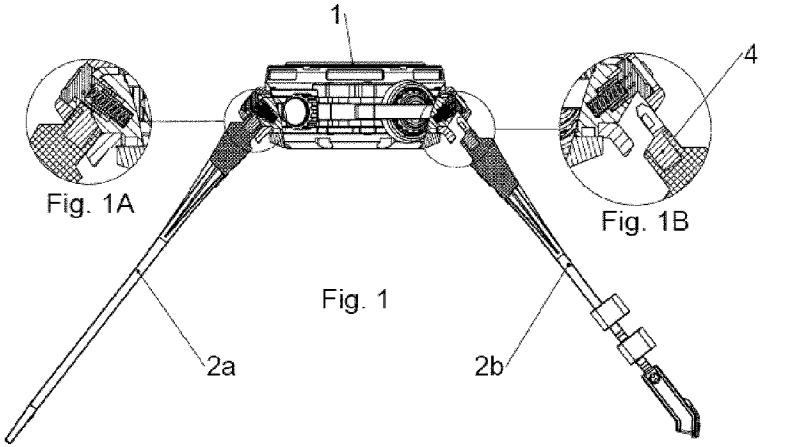
4
Fig. 1B
1
2b
Fig. 1
2a
Fig. 1A
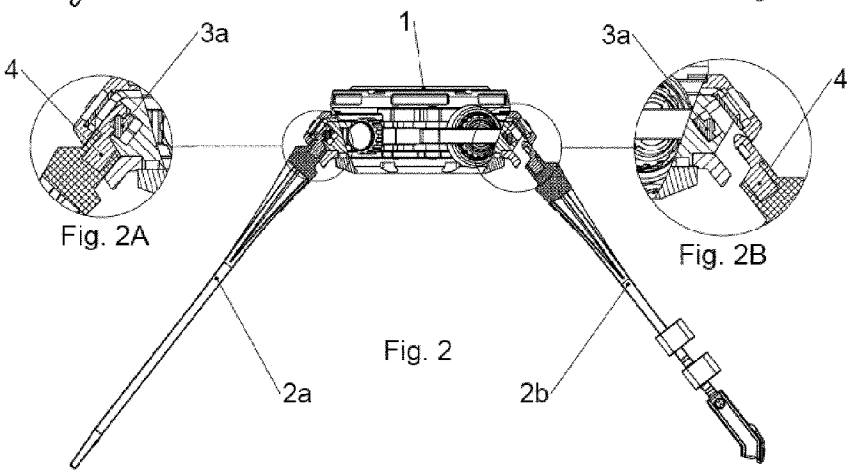
4
Fig. 2B
3a
1
2b
Fig. 2
2a
3a
Fig. 2A
4
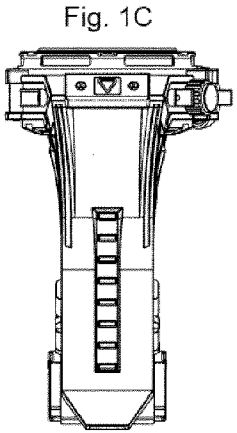
Fig. 1C
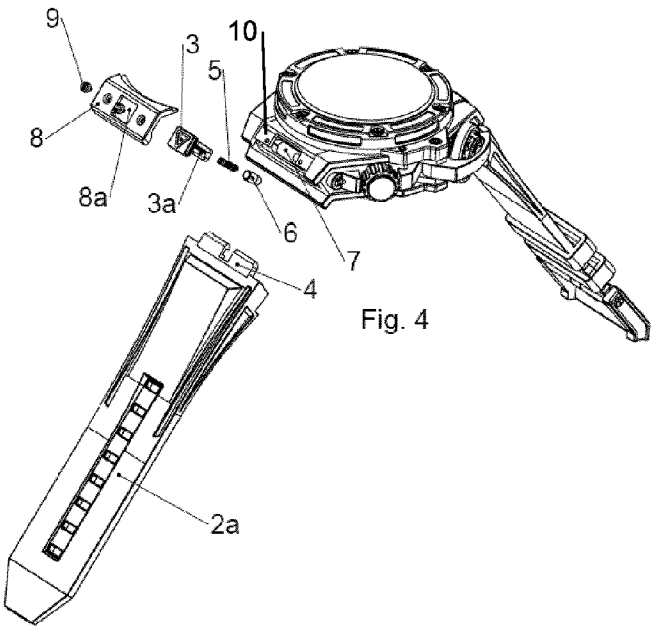
7
Fig. 4
4
6
10
5
2a
3
3a
8a
9
8

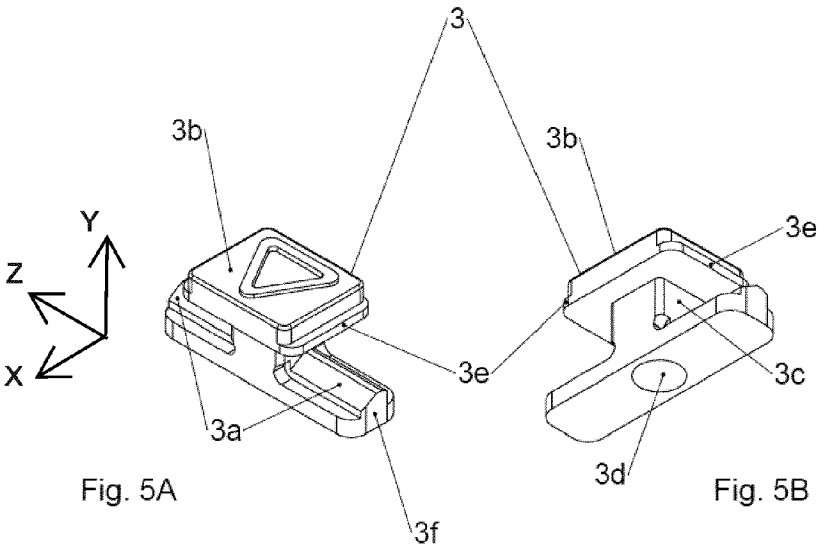
Fig. 5A
Fig. 5B
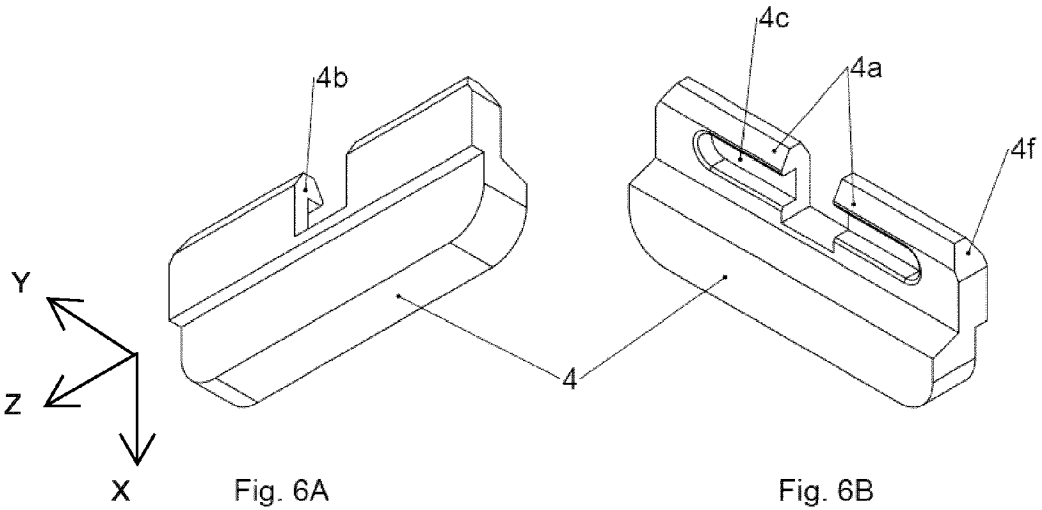
Fig. 6A
Fig. 6B

REMOVABLE CONNECTING DEVICE OF A WRIST BAND

BACKGROUND ART

The present invention relates to a device for removably connecting a wrist band to a component, in particular a watch case, to which the wrist band is to be attached, in particular a watch case, this device comprising two complementary coupling members respectively secured to the connection ends of said wrist band and said component. The invention also relates to a wristwatch comprising such a device. The invention further relates to a watch case having a coupling member adapted to cooperate with another complementary coupling member. The invention finally relates to a wrist band section having a coupling member adapted to cooperate with another complementary coupling member.

The most common way of fastening a wrist band between the lugs of a watch case is to use a spring bar. This bar has a fixing pin at each end, one of these pins being secured to a piston slidably mounted in the other, tubular part of the bar. A coil spring mounted in the tubular part is used to make the pin protrude from the tubular housing. The open end of the tubular wall is slightly inwardly deformed after inserting the piston to prevent the piston from coming out of the tubular portion.

The introduction and removal of a wrist band using this fastening method requires the use of tools to insert and maintain the piston in the tubular part. Such an operation requires some skill. In addition, once the bar has been successfully introduced between the lugs, the hole in the horns must be found in order to allow the spring to introduce this pin. Thus, this operation is not within the reach of everyone.

SUMMARY OF THE INVENTION

The goal of the present invention is to remedy, at least in part, the drawbacks of this fastening method and to bring the operation of replacing a wrist band within the reach of everyone.

To this end, an object of the present invention is essentially a removable connecting device of a wrist band to a component or a member to which the wrist band is to be attached, in particular a watch case, as defined by claim 1.

In this device, the coupling members of this device are oriented in a Z direction, for example, transversely to the longitudinal X direction of the wrist band; one of the coupling members is movable laterally, for example, in a Y direction, between two end positions, a first position in which it is engaged with the other of the coupling members, a second position in which it is dissociated from the other coupling member. Elastic return means tend to maintain the coupling member movable laterally between two end positions in its first position.

Preferably, the watch case has a seat for a removable stop element and means for fixing this stop element on the seat, this removable stop element defining the first end position of the coupling member movable between two end positions.

According to an advantageous embodiment of the invention, the coupling members have snap-fastening elements to permit causing the displacement of the removable coupling member between two end positions, against the pressure of said elastic return means, from its first to its second end position, during the coming into engagement of the two coupling members in a direction perpendicular to the transverse direction of the coupling members.

It is also advantageous for the removable stop member to have an opening to permit accessing the movable coupling member and moving it against the elastic return means to bring it into the second of its end positions.

This device is simple and allows the introduction and removal of the wrist band without tools or special skills and by each user.

BRIEF DESCRIPTION OF THE DRAWINGS

The accompanying drawings illustrate, schematically and by way of example, an embodiment of the device object of the invention.

FIG. 1 is a front view of a wrist watch;

FIGS. 1A and 1B are enlarged partial cross-sectional views of the cut left and right parts, respectively, of FIG. 1;

FIG. 1C is a left side view of the watch of FIG. 1;

FIG. 2 is a view similar to FIG. 1 with two other partial cross-sections;

FIG. 2A is an enlarged cross-sectional view of the left cut part of FIG. 2;

FIG. 2B is an enlarged cross-sectional view of the right cut part of FIG. 2;

FIG. 4 is a perspective view in which one of the removable connecting devices of the wrist band to the watch case is exploded;

FIGS. 5A and 5B are two enlarged perspective views of a coupling member of the removable connecting device according to the invention;

FIGS. 6A and 6B are two enlarged perspective views of the other coupling member of the removable connecting device according to the invention.

DETAILED DESCRIPTION OF PARTICULAR EMBODIMENTS

Figure 3A:
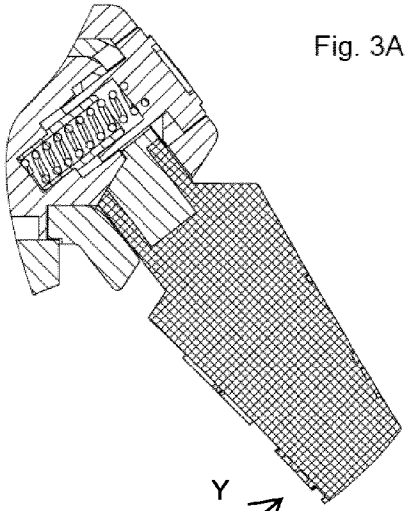
FIGS. 3A and 3B are cross-sectional views of the watch according to FIG. 3 along the lines BB and CC, respectively.
Figure 3B:
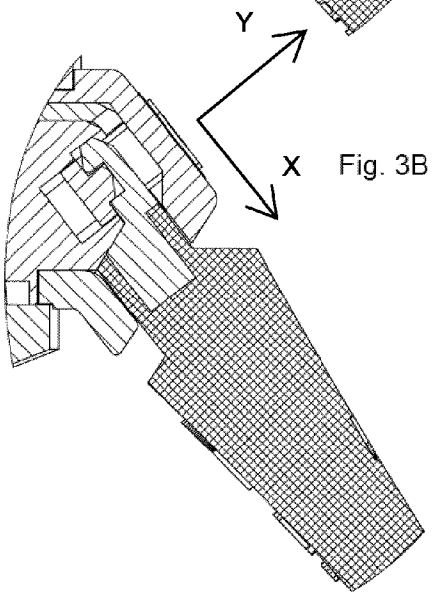
Figure 3:
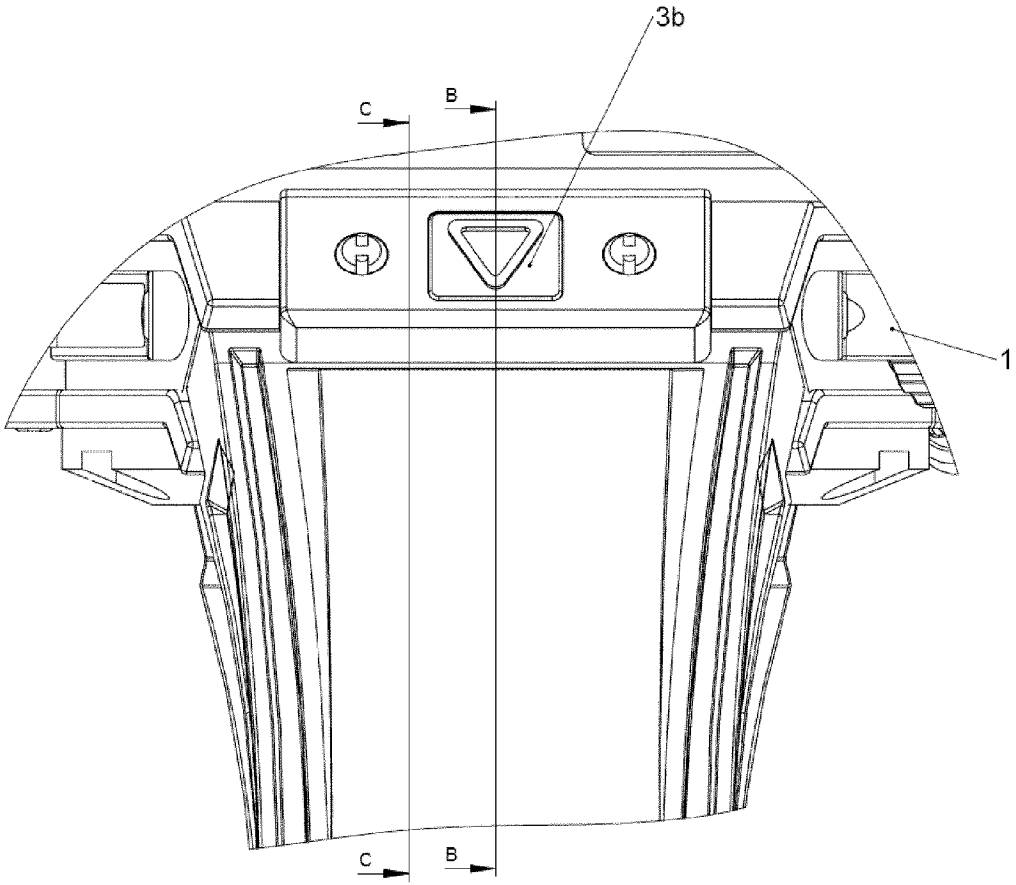
FIG. 3 is an enlarged partial front view of FIG. 1 rotated 90° counterclockwise.

Although the illustrated embodiment which will be described hereinafter relates to the connection of a wrist band to a watch, it is obvious that a similar device can be used to connect a wrist band to a component other than a watch case, such as a clasp, or even to a piece of jewelry.

FIGS. 1 and 2 illustrate a watch case 1, to each side of which an end of a wrist band section 2*a*, 2*b* is intended to be removably connected. FIGS. 1 and 2 show one end of the wrist band section 2*a* connected to the left side of the watch case 1 and one end of the wrist band section 2*b* separated from the right side of the watch case 1.

The connecting device object of the invention is illustrated in FIG. 4 and the two complementary coupling members 3 and 4 are illustrated separately in FIGS. 5A, 5B and 6A, 6B, respectively. The coupling member 4 is intended to be inserted into one end of the wrist and sections 2*a*, 2*b*, as illustrated in FIGS. 1A, 1B, 2A, 2B and 4. The coupling member 3 has a coupling element 3*a* bisected by a pusher member comprising a head 3*b* and a rod 3*c*. The underside of this rod 3*c* has a cylindrical housing 3*d* (FIG. 5B) for receiving a return spring 5 (FIG. 4). A sleeve 6 is intended to be fixed in an opening provided in the bottom of a rectangular recess 7 formed between the lugs of the watch case 1. This rectangular housing is intended to receive coupling element 3*a* and to position it, for example, along the Z direction, transversely to the longitudinal X direction of the wrist band 2*a*, 2*b*. The return spring 5, compressed between the bottom of the sleeve 6 and the bottom of the housing 3*d* formed in the pusher rod 3*c*, serves to push the coupling member 3 toward the outside of the case middle 1.

To limit the stroke of the coupling member 3, the head 3*b* of the pusher has two lateral support faces. These support faces are intended to bear against two opposite sides of a rectangular opening 8*a* of a stop member 8 (FIG. 4) under the pressure of return spring 5. This stop element 8 is shaped so as to fit on a seat 10 located in-between the lugs of the case 1 and is fixed by two screws 9 on this seat of the watch case 1.

A coupling member 4 is inserted at one end of each wrist band section 2*a*, 2*b*. This coupling member 4 comprises a coupling element 4*a* arranged transversely to the wrist band 2, for example, in the Z direction, and bisected by a passage 4*b* for receiving rod 3*c* of the pusher of the coupling member 3 during coupling of the coupling element on the coupling member 3. To allow this assembly of the two coupling members 3 and 4, the coupling member has a transverse housing 4*c* (FIG. 6B). To facilitate assembly and to make it automatic following a single push along the longitudinal direction of the wrist band 2 towards the case 1, the engagement faces 3*f*, 4*f* of the coupling member 3, respectively of coupling member 4, are tapered, thus forming a snap-fastening assembly, which permits assembly in one direction and prevents separation in the opposite direction.

Indeed, the separation can only be obtained by applying pressure to the head 3*b* of the pusher to move the coupling member 3, and in particular, to move it laterally along the Y direction, against the pressure of the return spring 5, as shown in FIG. 2B. Preferably, the head 3*b* of the pusher is embedded within the thickness of the board of the stop member 8 so that the pusher cannot be actuated inadvertently. In this case, a simple tip of a ballpoint pen, for example, permits actuating the head 3*b* of the pusher to disengage the coupling element 3*a* from the housing 4*c* and the coupling element 4*a* from the coupling member 4.

Thanks to the design of this connecting device, the user does not have to remove the stop member 8. This stop member, as well as the coupling member 3 and its return spring, are installed in the factory. The only action that the user is required to take is to press the pusher 3*b* when he or she wants to remove the wrist band. To put the wrist band back, a simple push along the longitudinal axis of the wrist band toward the watch case 1 is sufficient, since the coupling members are assembled by snap-fastening. In addition to its simplicity of design and use, the connecting device object of the invention provides security guarantees comparable to a conventional fastening with a bar.

In the embodiment described above, the X, Y and Z axes are perpendicular to each other in pairs. In other embodiments, these axes are not necessarily perpendicular. They can also be substantially perpendicular. In particular, the X and Y axes are not necessarily perpendicular.

In one embodiment, the watch case comprises the first coupling member 3 intended to cooperate with the second coupling member 4 provided on a wrist band section, the first coupling member being movable laterally between two end positions, a first position in which it is engaged with the second coupling member 4, a second position in which it is dissociated from this second coupling member 4, the elastic return means 5 tending to maintain the first coupling member 3 movable laterally between two end positions in said first position.

In this embodiment, the wrist band section comprises a second coupling member intended for cooperating with the first coupling member provided on the watch case.

In another embodiment, a wrist band section comprises the first coupling intended to cooperate with the second coupling member provided on the watch case, the first coupling member being movable laterally between two end positions, a first position in which it is engaged with the second coupling member, a second position in which it is dissociated from this second coupling member, the elastic return means tending to maintain the first coupling member movable laterally between two end positions in said first position.

In this embodiment, the watch case comprises a second coupling member intended to cooperate with the first coupling member provided on the wrist band section.

In one embodiment, the wristwatch has a first connecting member secured to a section of the wrist band and a second connecting member secured to the watch case.

The invention claimed is:

1. Removable connecting device for connecting a wrist band to a component to which the wrist band is to be attached, the device comprising:

first and second complementary coupling members configured to be secured to connection ends of said wrist band and of said component, respectively, and elastic return means, wherein said first and second coupling members are oriented transversely to a longitudinal direction of said wrist band, the first coupling member being movable laterally between a first end position in which said first coupling member is engaged with the second coupling member, and a second end position in which said first coupling member is dissociated from said second coupling member, wherein the elastic return means biases said first coupling member into said first end position, and wherein said first and second coupling members have snap-fastening elements to permit causing a movement of said first coupling member movable between two end positions, against a pressure of said elastic return means, from the first to the second end position during a coming into engagement of the first and second coupling members in a direction perpendicular to the transverse direction of said first and second coupling members.

2. Device according to claim 1, wherein said component has a seat for a removable stop element and means for fixing the stop element on the seat, the removable stop element defining said first end position of said first coupling member movable between two end positions.

3. Device according to claim 2, wherein said removable stop element has an opening to permit accessing said movable first coupling member and moving said first coupling member against said elastic return means to bring said first coupling member into the second end position.

4. Wristwatch comprising a device according to claim 3, wherein one of the first and second coupling members is secured to a wrist band section and the other of the first and second coupling members is secured to the watch case.

5. Wristwatch comprising a device according to claim 2, wherein one of the first and second coupling members is secured to a wrist band section and the other of the first and second coupling members is secured to the watch case.

6. Wristwatch comprising a device according to claim 1, wherein one of the first and second coupling members is secured to a wrist band section and the other of the first and second coupling members is secured to the watch case.

7. Device according to claim 1, wherein a removable stop element has an opening to permit accessing said movable first coupling member and moving said first coupling member against said elastic return means to bring said first coupling member into the second end position.

8. Wristwatch comprising a device according to claim 7, wherein one of the first and second coupling members is secured to a wrist band section and the other of the first and second coupling members is secured to the watch case.

9. Watch case, comprising:

a first coupling member configured to cooperate with a second coupling member provided on a wrist band section, so as to connect the wrist band section to the watch case, wherein the first coupling member is movable laterally between a first end position wherein said first coupling member can be engaged with the second coupling member, and a second end position in which said first coupling member can be dissociated from the second coupling member, and wherein the first coupling member is elastically biased into said first end position.

10. Watch case according to claim 9, further comprising a second coupling member configured to cooperate with the first coupling member, wherein the first coupling member is movable laterally between the first end position wherein said first coupling member is engaged with the second coupling member, and the second end position in which said first coupling member is dissociated from the second coupling member.

11. Watch case according to claim 10, further comprising a wrist band section, wherein the second coupling member is provided on the wrist band section so as to connect the wrist band section to the watch case.

12. Wristwatch comprising a watch case according to claim 10, wherein the second coupling member is secured to a wrist band section.

13. Wristwatch according to claim 12, comprising elastic return means, wherein the elastic return means biases said first coupling member into said first end position.

14. Wristwatch according to claim 13, wherein the watch case has a seat for a removable stop element and means for fixing the stop element on the seat, the removable stop element defining said first end position of said first coupling member movable between two end positions.

15. Watch case according to claim 9, comprising elastic return means, wherein the elastic return means biases said first coupling member into said first end position.

16. Watch case, comprising:

a second coupling member configured to cooperate with a first coupling member provided on a wrist band section, so as to connect the wrist band section to the watch case, the first coupling member being movable laterally between a first end position in which the first coupling member can be engaged with the second coupling member, and a second end position in which the first coupling member can be dissociated from the second coupling member, the first coupling member being elastically biased into said first end position.

17. Watch case according to claim 16, further comprising a first coupling member configured to cooperate with the second coupling member, wherein the first coupling member is movable laterally between a first end position wherein said first coupling member is engaged with the second coupling member, and a second end position in which said first coupling member is dissociated from the second coupling member, and wherein the first coupling member is biased into said first end position.

18. Watch case according to claim 17, further comprising a wrist band section, wherein the first coupling member is provided on the wrist band section so as to connect the wrist band section to the watch case.

19. Wristwatch comprising a watch case according to claim 17, wherein the first coupling member is secured to a wrist band section.

20. Wristwatch according to claim 19, comprising an elastic return means, wherein the elastic return means biases said first coupling member into said first end position.

21. Wristwatch according to claim 20, wherein the watch case has a seat for a removable stop element and means for fixing the stop element on the seat, the removable stop element defining said first end position of said first coupling member movable between two end positions.

22. Watch case according to claim 16, comprising an elastic return means, wherein the elastic return means biases said first coupling member into said first end position.

23. Removable connecting device for connecting a wrist band to a component to which the wrist band is to be attached, the device comprising:

first and second complementary coupling members configured to be secured to connection ends of said wrist band and of said component, respectively, wherein said first and second coupling members are oriented transversely to a longitudinal direction of said wrist band, the first coupling member being movable laterally between a first end position in which said first coupling member is engaged with the second coupling member, and a second end position in which said first coupling member is dissociated from said second coupling member, wherein the first coupling member is elastically biased into said first end position, wherein the second coupling member comprises a second coupling element that extends in a transverse direction, and wherein the second coupling element is divided in two lateral parts by a passage that receives a rod of the first coupling member.

24. Device according to claim 23, wherein the first coupling element extends in the transverse direction, and is divided into two lateral parts by the rod associated with a pusher element comprising a head, the first coupling element being configured to cooperate with a transverse housing of the second coupling member.

25. Device according to claim 23, wherein the first coupling member is biased into said first end position by a spring, and wherein the rod of the first coupling member comprises a cylindrical housing for receiving the spring.

* * * * *